US007306569B2

(12) United States Patent
LaJoie et al.

(10) Patent No.: US 7,306,569 B2
(45) Date of Patent: Dec. 11, 2007

(54) SYSTEMS AND METHODS FOR SKIN CARE

(75) Inventors: Aldran H. LaJoie, 25292 Rockridge Rd., Laguna Hills, CA (US) 92653; Jeffrey L. Kelsoe, San Diego, CA (US)

(73) Assignee: Aldran H. LaJoie, Laguna Niguel, CA (US)

( * ) Notice: Subject to any disclaimer, the term of this patent is extended or adjusted under 35 U.S.C. 154(b) by 9 days.

(21) Appl. No.: 11/169,963

(22) Filed: Jun. 28, 2005

(65) Prior Publication Data

US 2006/0009719 A1 Jan. 12, 2006

Related U.S. Application Data

(60) Provisional application No. 60/584,840, filed on Jun. 30, 2004.

(51) Int. Cl.
*A61H 1/00* (2006.01)

(52) U.S. Cl. ..... 601/70; 601/17; 601/72

(58) Field of Classification Search ..... 601/46, 601/72, 17, 70; 401/6, 183–188; 15/29, 15/31, 97.1
See application file for complete search history.

(56) References Cited

U.S. PATENT DOCUMENTS 5,671,497 A * 9/1997 Abdo ..... 15/144.1
5,857,233 A * 1/1999 Wynn ..... 15/97.1
5,961,235 A * 10/1999 Kennedy ..... 401/6
6,009,887 A * 1/2000 Hertel ..... 132/317
6,129,469 A * 10/2000 Messer et al. ..... 401/6
6,290,976 B1 9/2001 Messenger
6,579,251 B1 6/2003 Randoll
6,652,888 B2 11/2003 Rhoades
2002/0156402 A1 10/2002 Woog et al.

* cited by examiner

*Primary Examiner*—Michael A. Brown
(74) *Attorney, Agent, or Firm*—Orrick, Herrington & Sutcliffe LLP

(57) ABSTRACT

The systems described herein provide an improved skin care system including a handheld device having a contact head movable in a three-dimensional orbital manner having a contact surface for contacting the skin. A skin care product can be applied to the skin via the contact surface. The contact head is adaptable to skin and body contours. The handheld device can include an activatable motion system for moving the contact surface in an angular orbital manner about an axis normal to the surface. The motion system can also cause the contact surface to deflect in a direction and radially rotate the direction of deflection in a clockwise or counter-clockwise manner. The orbital rotation can be continuous, stepped, random and the like.

31 Claims, 11 Drawing Sheets

SYSTEMS AND METHODS FOR SKIN CARE

CROSS-REFERENCE TO RELATED APPLICATIONS

This application is related to U.S. Provisional Application Ser. No. 60/584,840, filed Jun. 30, 2004, entitled "SYSTEMS AND METHODS FOR SKIN CARE," which is incorporated herein by reference.

FIELD OF THE INVENTION

The invention relates generally to systems for skin care, and more particularly, to systems for contacting the skin with a handheld device for product application, exfoliation and the like.

BACKGROUND INFORMATION

The consumer desire for healthy skin has fueled the development of a host of skin care products. While the effectiveness and quality of these products has improved over time, the development of means for applying these products to the skin has lagged behind. Although the need for more advanced application techniques is present throughout the skin care industry, the need is felt most with regard to products that benefit from thorough application or exposure to the skin, such as skin exfoliators, moisturizers and the like.

Several systems have been introduced to facilitate the application of skin care products to the skin. One such system takes the form of a handheld motorized applicator with an application surface that comes into contact with the skin. A skin care product is placed on the applicator surface and the device is activated, causing the surface to vibrate. The product is applied upon contact of the vibrating surface with the skin. If the product is an exfoliator, the vibrating motion allows the abrasive product to rub against the skin and exfoliate the tissue. If the product is a moisturizer and the like, the vibrating surface rubs the moisturizer into the skin to enhance the moisturizing effect.

While these systems allow automated application of a skin care product, the actual application motion and technique is less than optimal. For instance, these conventional systems are limited in being able to adapt or adjust to the contours of the skin, such as when a product is applied over the face and chin. This is because the orientation of the application surface is fixed and the vibrations are limited only to motion along the plane of the surface. Furthermore, this vibration only incrementally increases contact with the skin and the user or subject must manually move the applicator across the skin and physically work the skin care product into the skin such as through massaging or rubbing the applicator surface onto the skin. In addition, the limited vibrational movement does not allow for thorough exposure and contact of the product to the skin.

Accordingly, improved skin care systems are needed that can overcome these disadvantages of the conventional systems.

SUMMARY

The systems and methods described herein provide for a skin care system including a handheld skin care device. In one exemplary embodiment, the skin care device includes a device housing and a motion system coupled with the device housing, the motion system having a contact surface for contacting the skin of a subject, wherein the position of the contact surface is adaptable to the contours of the skin. The contact surface can also be movable in an orbital manner in three directions.

In one embodiment, the contact surface is movable in an orbital manner about a first axis normal to the contact surface, the first axis located substantially in the center of the contact surface. This angular orbital movement can be in a back and forth manner about the axis. In another embodiment, the contact surface is deflectable in a plurality of directions and orbitally movable such that the direction in which the surface is deflected shifts radially in a clockwise or counter-clockwise manner. The direction of deflection can shift radially in a continuous, stepped or random manner and the like. This orbital deflection of the contact surface can occur simultaneously with the angular orbital motion of the contact surface. The orbital deflection can also provide an increased range of motion allowing more efficient movement of the handheld device over the skin. To adapt to the contours of the skin or body, the contact surface can be biased towards a rest position having a first orientation and deflectable from the rest position to an adjusted position having a second orientation. The contact surface can also be retractable from the rest position to a retracted position.

In another embodiment, the handheld device also includes an elastic membrane coupled with the housing over an open portion of the housing, a motor located within the housing and a contact head coupled with the motor such that the elastic membrane is located therebetween, wherein the contact surface is located thereon. In addition, the device can be configured such that the contact head and motor are substantially suspended by the membrane. Also, the contact head can further include a motor head coupled with the motor and a contact unit configured to couple with the motor head, wherein the contact surface is located on the contact unit or on an applicator coupled with the contact unit.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. It is also intended that the invention is not limited to require the details of the example embodiments.

BRIEF DESCRIPTION OF THE FIGURES

The details of the invention, including fabrication, structure and operation, may be gleaned in part by study of the accompanying figures, in which like reference numerals refer to like segments.

DETAILED DESCRIPTION

The systems and methods described herein provide improved skin care systems having an automatic handheld skin care device with a contact surface capable of three-dimensional orbital motion for use in a desired skin care application. The contact surface can also be configured to adapt to the contours of the skin, such as, for instance, when used over a subjects face, cheeks and chin. These systems and methods are suitable for use in numerous skin care applications, including the application of skin care products to the skin, exfoliation of the skin with an exfoliation product, direct contact with the skin without the use of an skin care product and the like.

Figure 1:
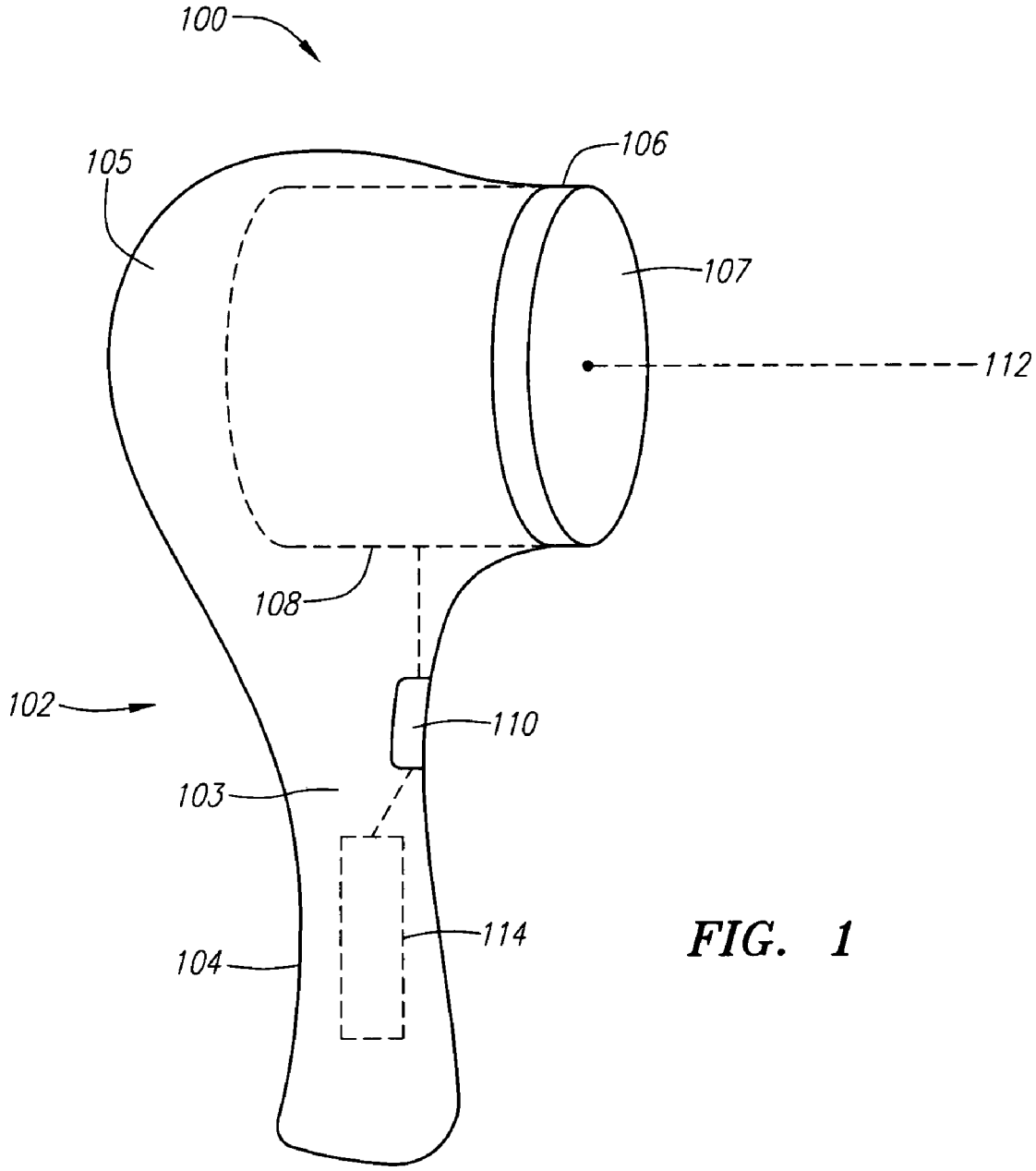
FIG. 1 depicts a perspective view of one exemplary embodiment of a skin care system including a handheld skin care device.

FIG. 1 depicts a perspective view of a preferred embodiment of the skin care system 100. Skin care system 100 includes handheld device 102 having device housing 103, movable contact head 106 having contact surface 107, motion unit 108 (shown to be inside housing 102) and activator 110 such as a switch. Housing 103 preferably includes handle portion 104 and motion unit cavity portion 105, for housing motion unit 108. Motion unit 108 is electrically coupled with activator 110, which is in turn coupled with power supply 114. Activator 110 can be used to activate the handheld device 102 and also, if desired, to select one of multiple operating rates. The motion unit 108 is also coupled with contact surface 107 and is used to move contact surface 107, preferably in a three-dimensional orbital manner. Contact surface 107 is preferably configured for contacting the skin of a subject or user in a desired skin care application. Contact surface 107 can have any surface texture and composition according to the needs of the application, and can be configured to apply a skin care product to the skin or contact the skin directly without an additional product. In this embodiment, contact surface 107 is generally planar. Contact surface 107 can have any shape in accordance with the needs of the application. In this embodiment, contact surface 107 is generally circular.

As mentioned above, contact surface 107 is preferably capable of three-dimensional orbital motion and adaptable to the contours of the skin. The motion is referred to as three-dimensional orbital motion. This three-dimensional orbital motion can include generally angular orbital movement about an axis normal to the contact surface, as depicted in FIGS. 2A-C, as well as generally linear orbital movement resulting from a deflection of contact surface 107 in one direction, and then shifting the deflected direction radially as depicted in FIGS. 3-4.

Figure 2A:
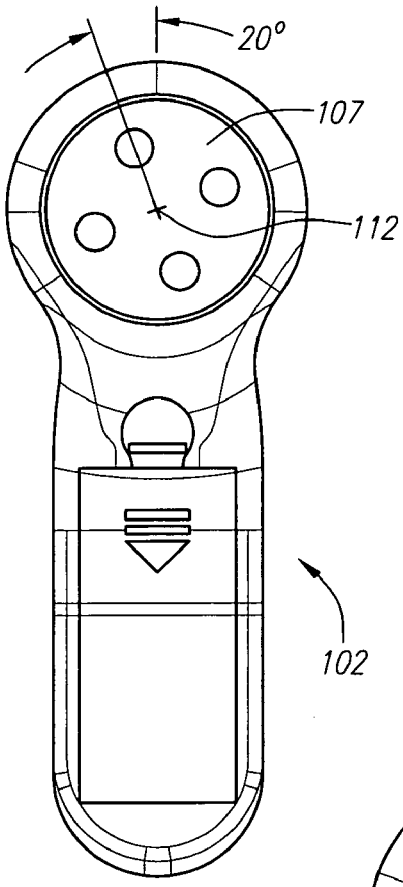
FIGS. 2A-C depict front schematic views of another exemplary embodiment of a handheld device at various stages of angular orbital motion.
Figure 2B:
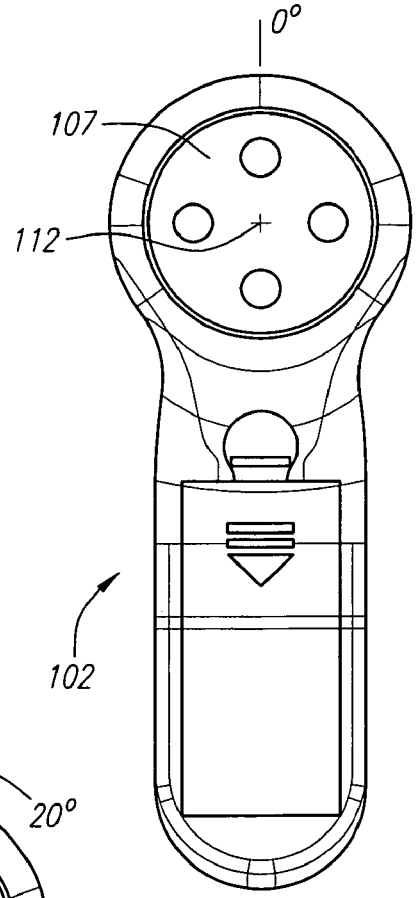
Figure 2C:
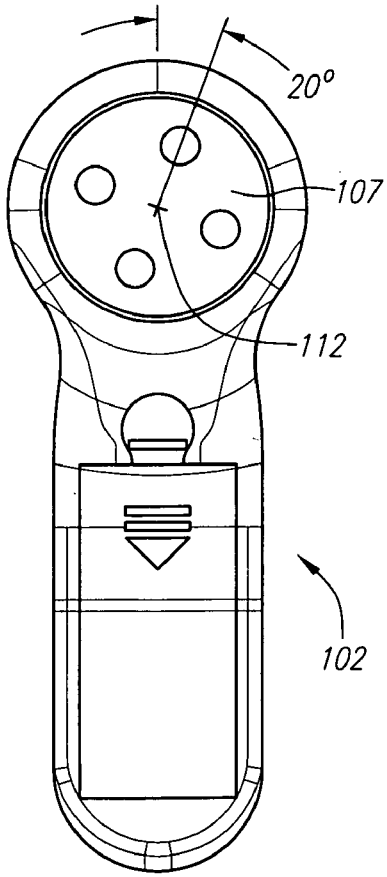

FIGS. 2A-C depict front schematic views of one exemplary embodiment of handheld device 102 with contact surface 107 at various stages during the angular orbital motion. During operation of the handheld device 102, contact surface 107 moves orbitally about axis 112, which is normal to contact surface 107. In a preferred embodiment, contact surface 107 moves orbitally back and forth, i.e., clockwise and counter-clockwise, across a desired angular range. FIG. 2A depicts contact surface 107 at a first limit of the angular orbital motion, offset by approximately −20 degrees from the center position depicted in FIG. 2B. FIG. 2C depicts contact surface 107 at a second limit of the angular orbital motion, offset by approximately +20 degrees from the center position of FIG. 2B, giving contact surface 107 a range of travel of approximately 40 degrees. It should be noted that these values are used solely as an example, and that contact surface 107 can be configured to move across any range as desired. Furthermore, contact surface 107 can be configured to rotate continuously in a given direction, e.g., clockwise or counter-clockwise, instead of moving back and forth in accordance with the needs of the application.

FIG. 3 depicts a perspective view of another exemplary embodiment of handheld device 102 further illustrating the orbital motion of contact surface 107. In addition to the angular orbital motion described with respect to FIGS. 2A-C, contact head 106 can also be configured to move orbitally as depicted here. This motion preferably occurs simultaneously with the angular orbital motion. FIG. 3A depicts handheld device 102 at rest while motion unit 108 is inactivated, or off. In this embodiment, contact surface 107 is planar and axis 112 is normal to surface 107. FIG. 3B depicts handheld device 102 at a first position during operation, where contact surface 107 is deflected by angle 302 in an upward direction from the original position of axis 112 in FIG. 3A, which is now depicted as segmented line 304. The portion of contact surface 107 deflected inwards towards handheld device 102 is shown by shaded region 310, which in this embodiment includes the upper half of contact surface 107.

Figure 3A:
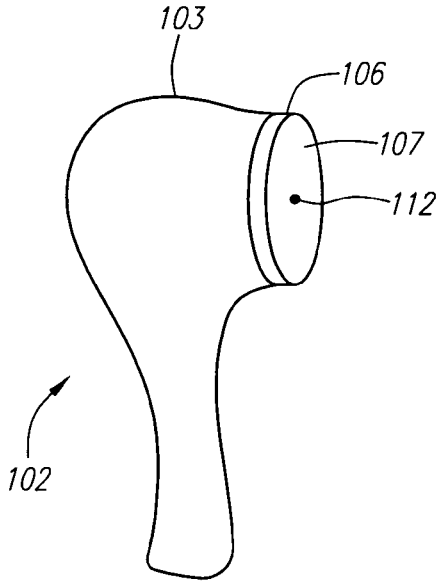
FIGS. 3A-D depict perspective views of another exemplary embodiment of a handheld device with a contact surface deflected in various directions at various stages of orbital motion.
Figure 3B:
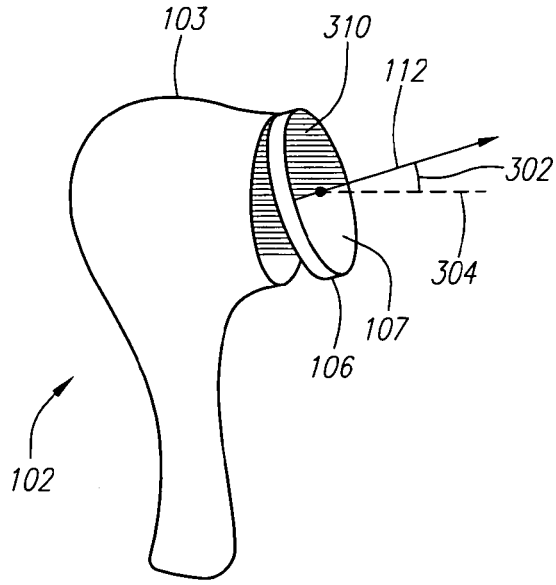
Figure 3C:
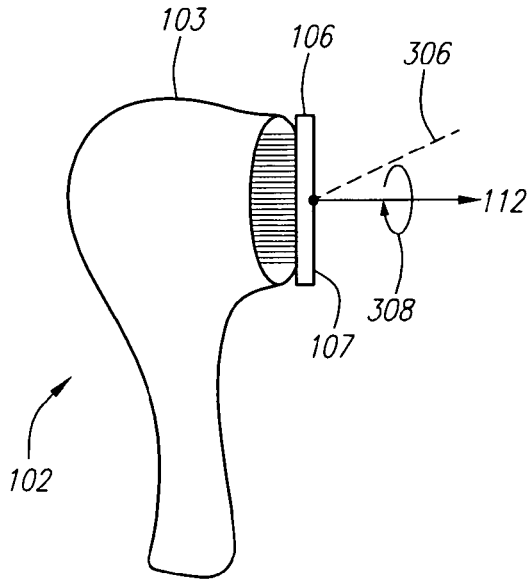

FIG. 3C depicts handheld device 102 at a second position during operation, where the direction of deflection of contact surface 107 has shifted radially by approximately 90 degrees, or one quarter orbital rotation. Contact surface 107 is now deflected generally to the right hand side of the figure. The position of axis 112 in FIG. 3B is shown here by segmented line 306. The path that axis 112 follows during the orbital movement of contact surface 107 is shown by orbital directional arrow 308, which can be either clockwise (shown here) or counter-clockwise. It should be noted that the orbital motion of contact surface 107 from the position in FIG. 3B to that depicted in FIG. 3C can be either continuous or in a stepped fashion, e.g., by changing the direction of deflection from an upwards direction directly to deflection to the right side. The stepped rotation can be in predetermined increments or can be in a random or pseudo-random manner, as will be discussed in detail below.

Figure 3D:
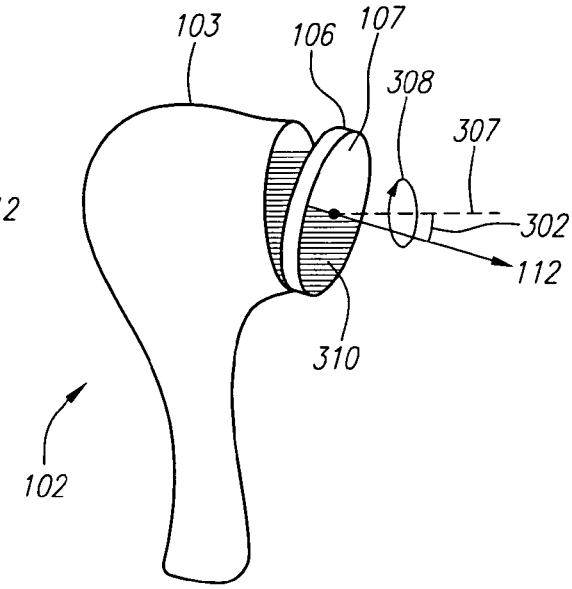

FIG. 3D depicts handheld device 102 at a third position during an orbital rotation, where the direction of deflection of contact surface 107 has shifted radially by approximately 180 degrees, or a one half orbital rotation, from the position depicted in FIG. 3B. Contact surface 107 is now deflected downwards, preferably by angle 302. The position of axis 112 in FIG. 3C is shown here by segmented line 307. Contact surface 107 can moves orbitally in this manner to complete the entire 360 degree rotation. It should be noted that the degree of deflection, angle 302, can be constant throughout the orbital rotation or can change during the rotation.

Figure 4A:
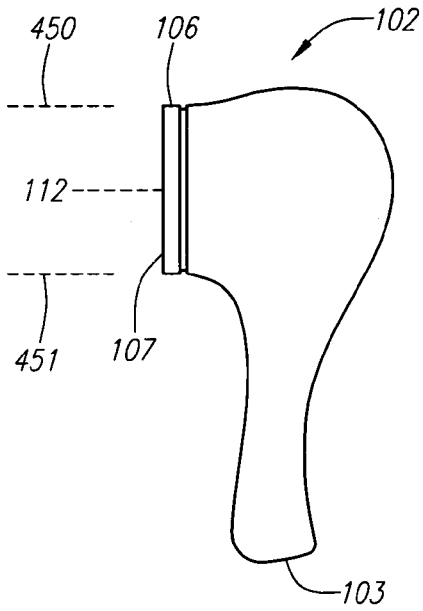
FIGS. 4A-D depict side schematic views of another exemplary embodiment of a handheld device with a contact surface deflected in various directions at various stages of orbital motion.
Figure 4B:
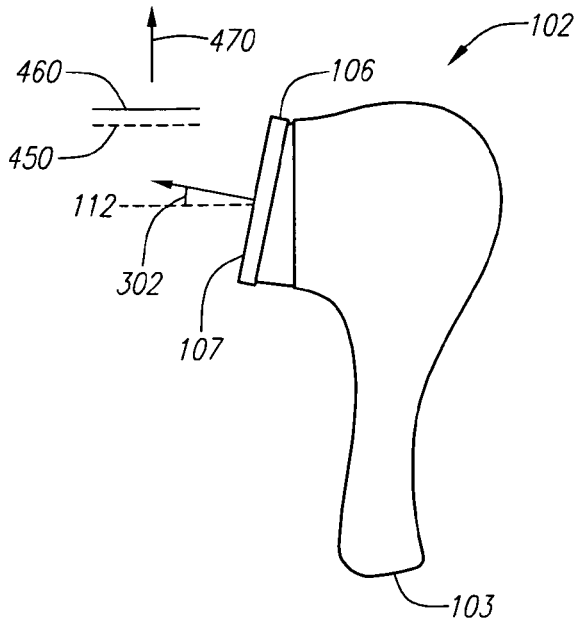
Figure 4C:
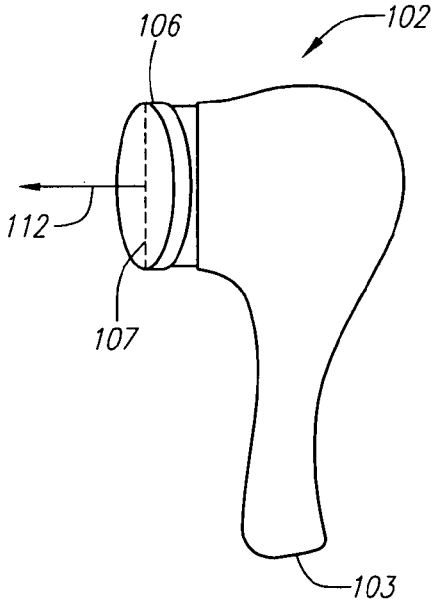
Figure 4D:
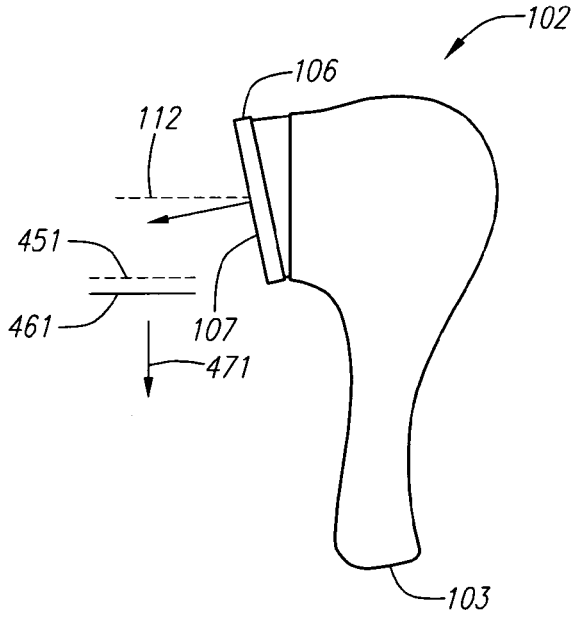

FIGS. 4A-D depict side views of an exemplary embodiment of handheld device 102 at various stages of orbital rotation, similar to those depicted in FIGS. 3A-D. FIG. 4A depicts handheld device 102 at a resting position similar to that depicted in FIG. 3A. FIG. 4B depicts the upwards deflection of contact surface 107 by angle 302 similar to the stage of orbital motion depicted in FIG. 3B. FIG. 4C depicts the deflection of contact surface 107 after the direction of deflection has shifted by 90 degrees from the stage depicted in FIG. 4B. FIG. 4D depicts the deflection of contact surface 107 after the direction of deflection has shifted by 180 degrees from the stage depicted in FIG. 4B.

During the orbital motion, handheld device 102 preferably exhibits an increased range of motion for contact head 106, such as in the embodiment depicted in FIGS. 4B and 4D. This increased range of motion allows quicker, easier and more efficient application of a skin care product to the skin. As mentioned above, conventional vibrating devices require the user to manually move the device across the skin to apply a skin care product. In addition, these vibrating devices require the user to physically work the skin care product into the skin.

In contrast, the increased range of motion allows handheld device 102 to move across the face automatically and lessens the amount of work required by the user. The user may only need to provide minimal guidance to steer device 102 over the desired portions of the skin. The user is not required to move device 102 manually across the skin and is not required to physically work the skin care product into the skin with the same amount of effort as in conventional devices.

FIG. 4A depicts reference lines 450 and 451, which reflect the position of contact surface 107 in the resting position. During orbital motion, the range of motion of contact head 106, and accordingly, contact surface 107, is increased. Reference line 460, depicted in FIG. 4B, shows the position of contact surface 107 when deflected upwards. Here, it can be seen that contact surface 107 extends further than when in the resting position and has shifted laterally in direction 470. As another example, reference line 461, depicted in FIG. 4D, shows the position of contact surface 107 when deflected downwards. Again, it can be seen that contact surface 107 extends further than when in the resting position and has shifted laterally in direction 471. The amount by which the range of motion is increased can be adjusted based on the needs of the application for which handheld device 102 is designed or configured. In one exemplary embodiment, the increased range of motion, or the distance between reference lines 450 and 460 or between lines 451 and 461, is one quarter inch, but this distance can be shorter or longer as desired.

During operation, contact surface 107 preferably makes successive orbital rotations at any selected or predetermined rate. This rate can be chosen as desired based on the needs of the application. Furthermore, handheld device 102 can be configured to operate at multiple different rates to provide flexibility and allow device 102 to be used in a wide variety of applications. For instance, in one embodiment, surface 107 can be configured to rotate orbitally at a slow rate of 60 rotations per minute (rpm) and also at a fast rate of 1000 rpm. Device 102 can also be configured to operate at any number of speeds between the slow and fast rates. These exemplary rates are included only for purposes of illustration. One of skill in the art will readily recognize that device 102 can be configured to operate at any desired rate.

Figure 5A:
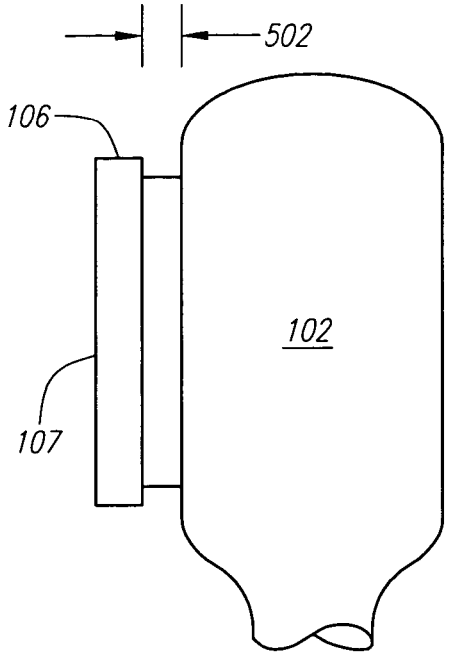
FIGS. 5A-C depict side schematic views of another exemplary embodiment of a handheld device with an adjustable contact surface with varying amounts of adjustment in response to an external force.

As mentioned above, handheld device 102 is capable of adapting to the body contours of a subject or user as device 102 is passed over the skin. Preferably, the position of contact head 106 is biased towards a rest position and variably adjustable or retractable from the rest position such that contact surface 107 can adapt to wide range of skin contours. FIG. 5A depicts an exemplary embodiment of handheld device 102 with contact head 106 in the rest position. Contact head 106 is preferably biased towards this rest position but adjustable upon the application of pressure to contact surface 107, such as that which would be exerted by the skin as device 102 is pressed against the skin.

Figure 5B:
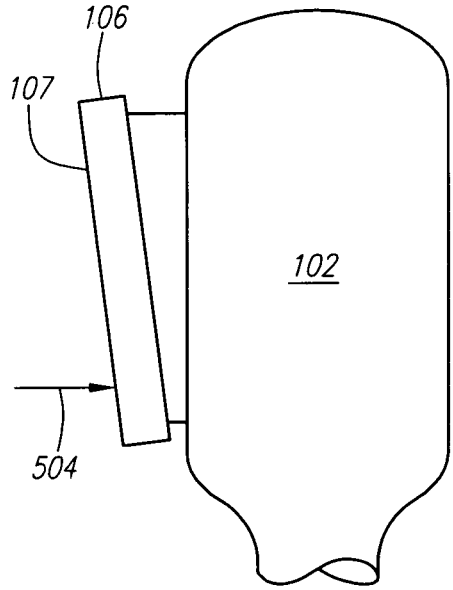

FIG. 5B depicts an example where pressure is exerted against the lower portion of contact surface 107 in direction 504 causing the orientation of contact head 106 to deflect accordingly. Here, when pressure is applied to the lower portion of contact head 106, the orientation of contact head 106 can deflect. Preferably, contact head 106 is deflectable in any direction to provide a high degree of adaptability to the contours of the skin. As a result of the deflection, contact surface 107 lies on a plane which is oblique to the plane of the rest position. One of skill in the art will readily recognize that this same orientational adaptability can be provided in embodiments where contact surface 107 lies substantially along a plane, i.e., surface 107 is curved or includes surface features.

Figure 5C:
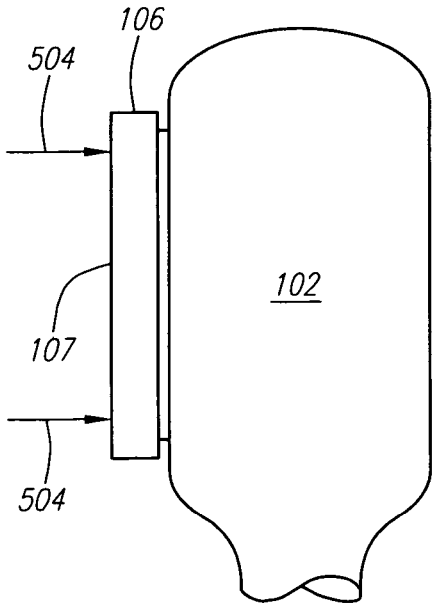

FIG. 5C depicts an example where pressure is exerted in multiple locations over contact surface 107 causing contact head to adjust or retract in one direction to a retracted position. Here, the contact surface lies on a plane which is parallel to the plane of the rest position. In this embodiment, the range of retractability is limited by the size of gap 502, however, gap 502 can be sized to accommodate the needs of the application, or device housing 102 can be configured to allow contact head 106 to pass into housing 102 to extend the range of allowable retraction. It should be noted that contact head 106 can be configured to retract and deflect to provide a high degree of adaptability to body or skin contours. It should also be noted that contact head is capable of retraction and orientational adjustments while contact head is moving in an orbital manner as described with respect to FIGS. 2-4 above.

Figure 6:
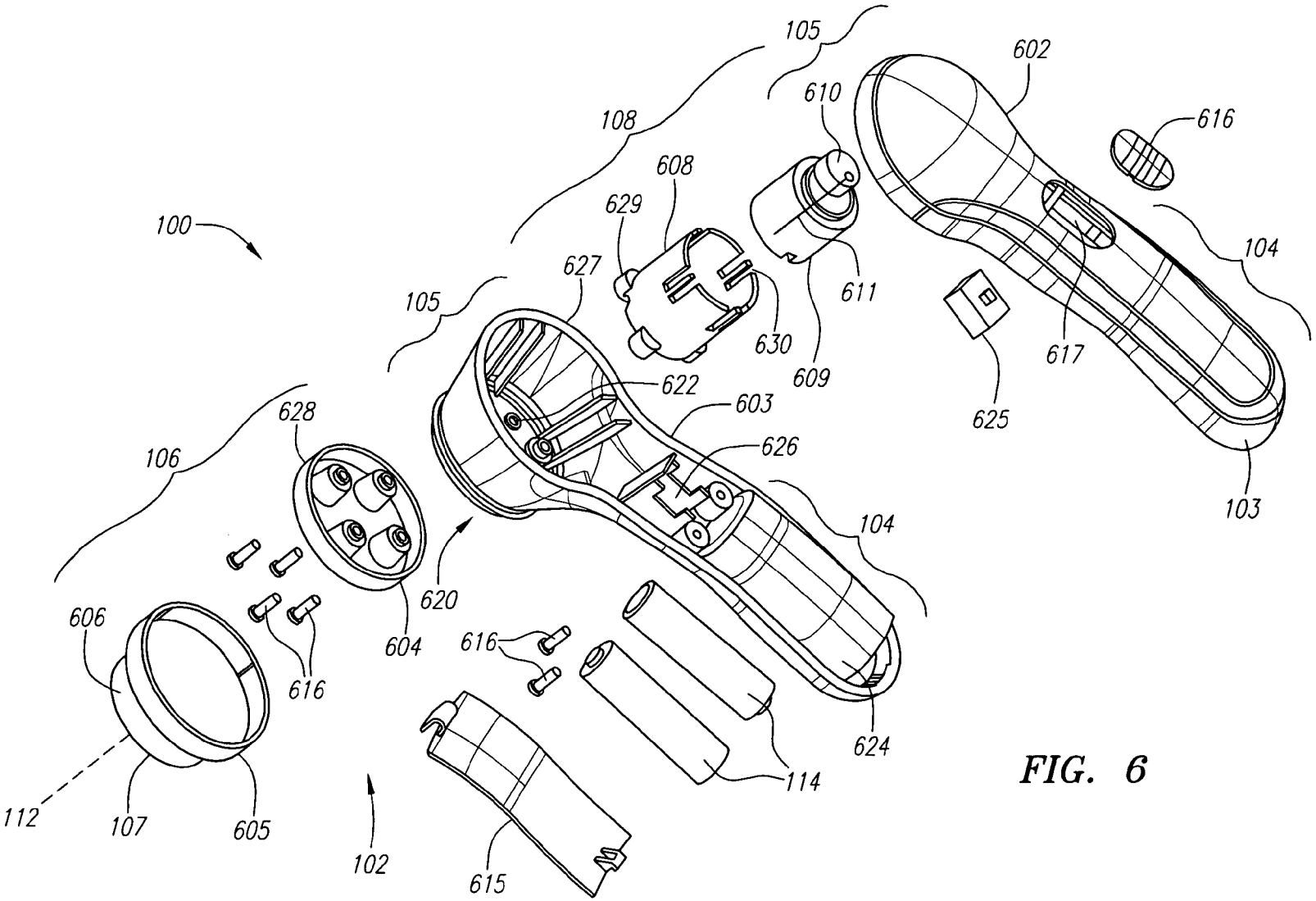
FIG. 6 depicts an exploded perspective view of another exemplary embodiment of a handheld device.

Another exemplary embodiment of skin care system 100 will now be described in more detail. FIG. 6 depicts an exploded perspective view of an embodiment of handheld device 102 having a device housing 103, contact head 106, motion unit 108, activator 110 and power supply 114. Here, housing 103 includes a back housing 602 and a front housing 603, which can be coupled together to house various components of system 600. Front housing 603 has an open portion 620 over which elastic membrane 622 is placed. Front housing 603 also includes a power supply housing 624 and power supply cover 615 for housing power supply 114, as well as an activator housing 626 for housing activator switch 625. Activator switch 625 extends through an aperture 617 in back housing 602 and couples with activator switch cover 616 to form activator 110. One of skill in the art will readily recognize that activator 110 can take the form of any activation means, such as a switch, button, lever, touch pad and the like.

Contact head 106 includes motion head 604 and contact unit 605. Contact unit 605 is preferably configured to removably couple with motion head 604 and, in this embodiment, contact unit 605 is configured to slide over motion head 604. Motion system 106 includes motor housing 608 and motor 609. Motor 609 includes a driveshaft 611 with an offset weight 610 coupled to the back end of driveshaft 611. Motor housing 608 is configured to house motor 609 and includes grasping members 630 for coupling with and retaining motor 609. Motor housing 608 also includes four feet 629 for coupling with motion head 604 through apertures 627 is membrane 622. Motion head 604 includes corresponding apertures 628 through which screws or other attaching members can be passed in order to couple motion head 604 with motor housing 608. Preferably, the motor head 604 and motion unit 108 combination substantially rests suspended on membrane 622.

Figure 7A:
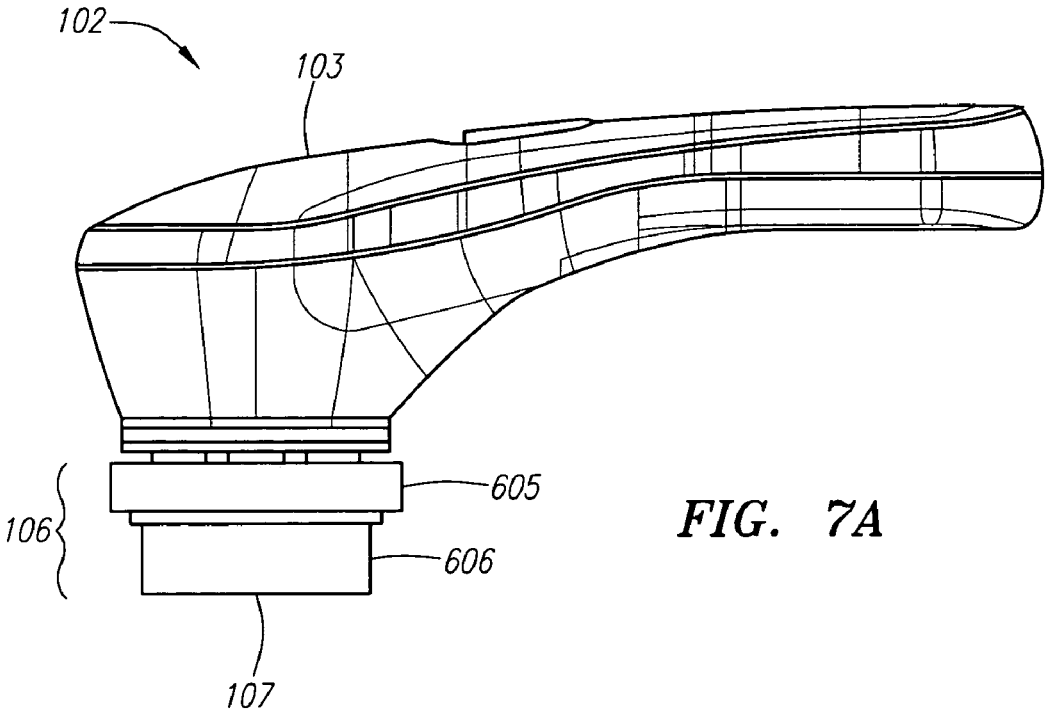
FIGS. 7A-B depict side and top schematic views of another exemplary embodiment of a handheld device.
Figure 7B:
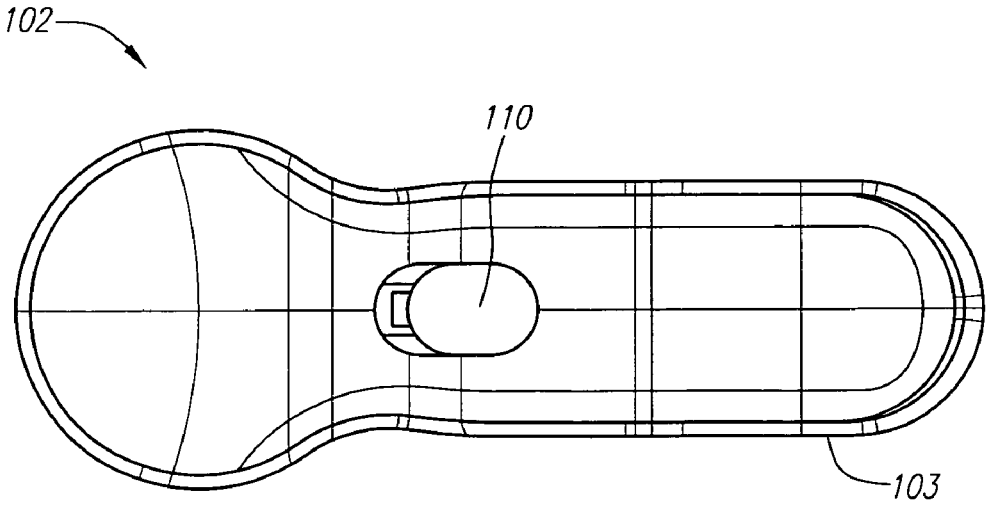

FIGS. 7A and 7B depict side and back schematic views, respectively, of one exemplary embodiment of handheld device 102. Here, contact unit 605 is shown with an applicator 606 having contact surface 107. This embodiment of contact unit 605 is preferably used to apply a skin care product to the skin. Applicator 606 is preferably composed of a soft and porous material, such as a sponge, foam pad and the like. These materials are suitable for retaining or storing the skin care product and are soft enough to apply the product to the skin without damage. The sponge, or sponge-like material, which forms applicator 606 can be open cell or closed cell and can have any degree of absorbancy or non-absorbancy desired for the individual application. When used with abrasive skin care products, such as exfoliators and the like, applicator 606 can be composed of a stiffer foam or sponge-like material to facilitate the exfoliation process. Alternatively, contact unit 605 can be implemented without applicator 606 and contact surface 107 can be applied directly to the skin without the aid of a soft applicator. This configuration may be preferable when a hard, rigid or textured contact surface 107 is desired for deep exfoliation procedures and the like.

Figure 8:
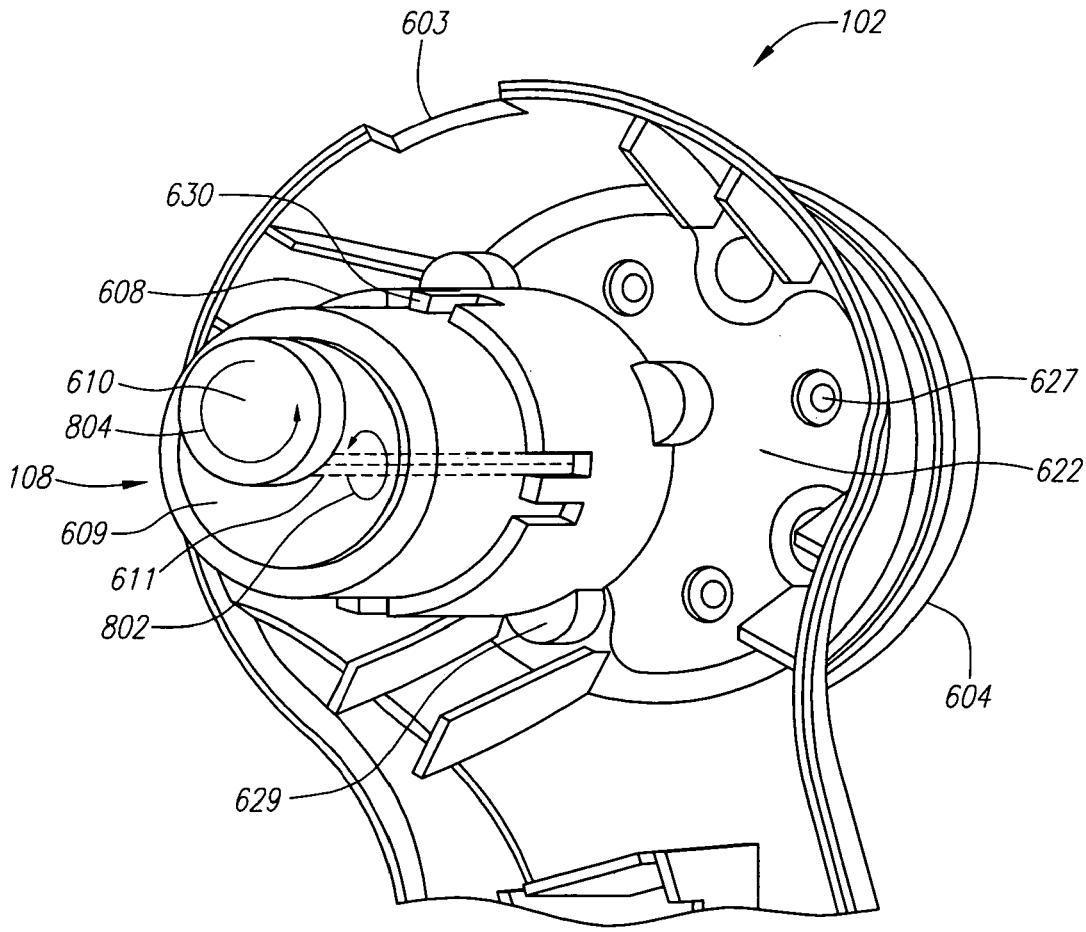
FIG. 8 depicts an exploded perspective view of an exemplary embodiment of a motion system within a device housing.
Figure 9A:
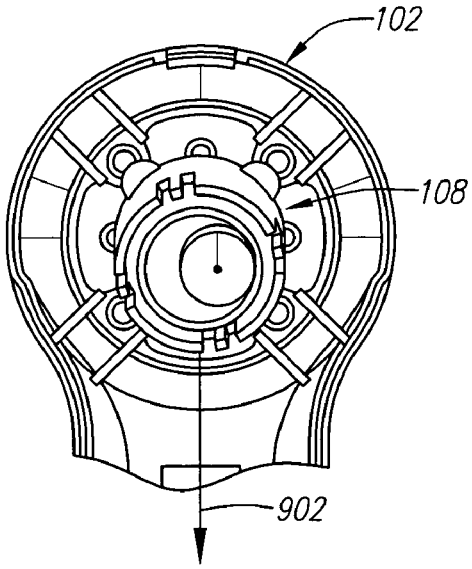
FIGS. 9A-H depict perspective views of another exemplary embodiment of a motion system within a device housing at various stages during operation of a motor.
Figure 9B:
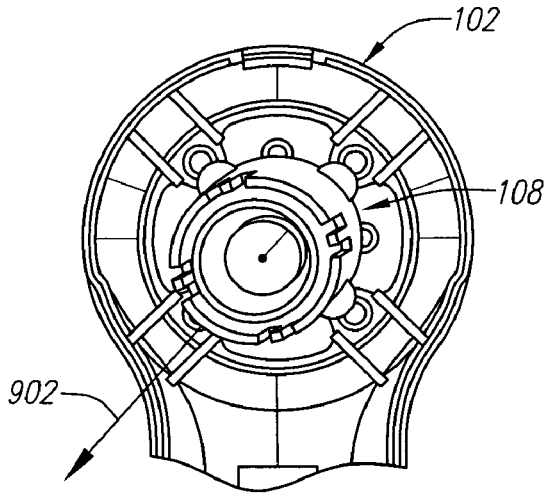
Figure 9C:
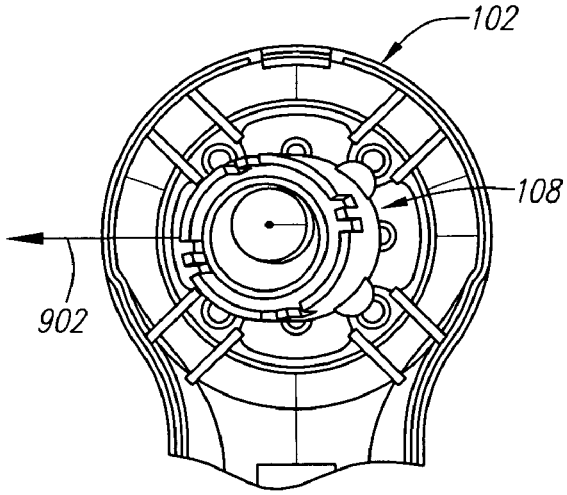
Figure 9D:
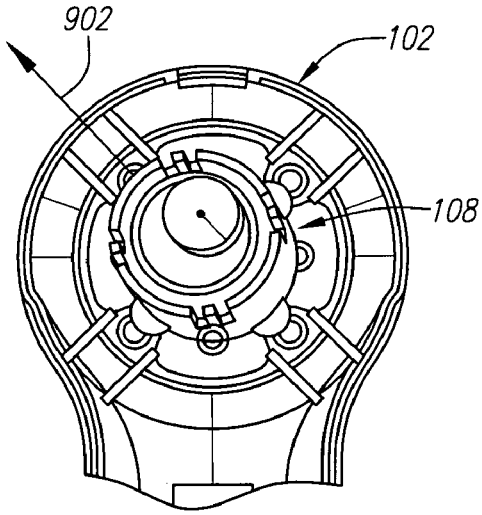
Figure 9E:
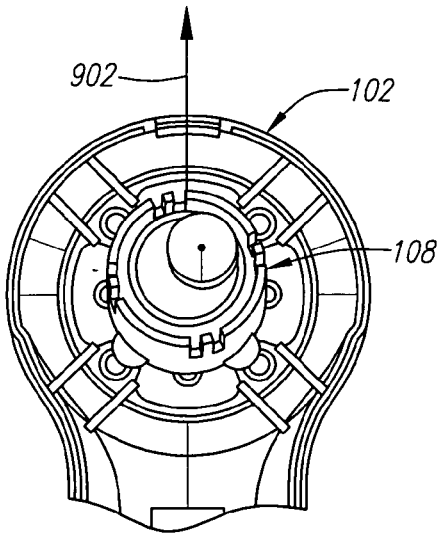
Figure 9F:
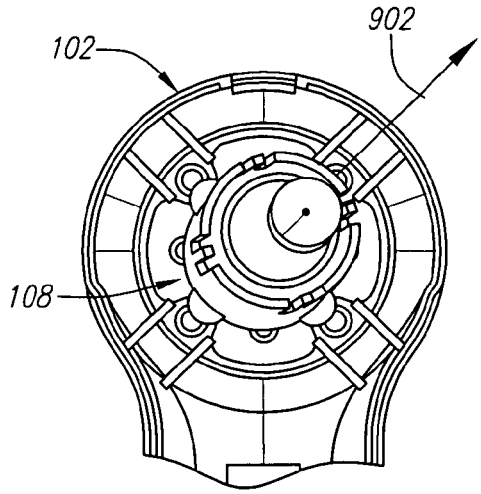
Figure 9G:
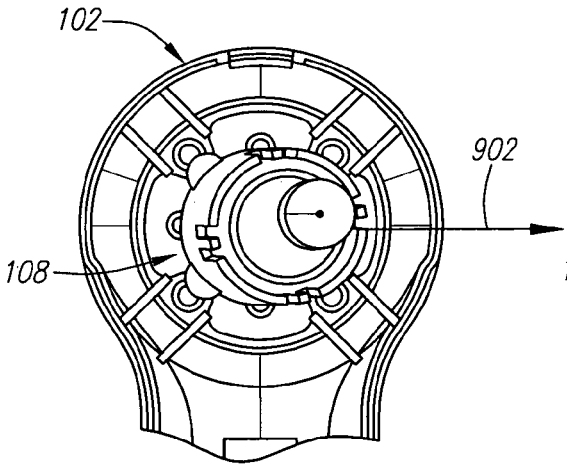
Figure 9H:
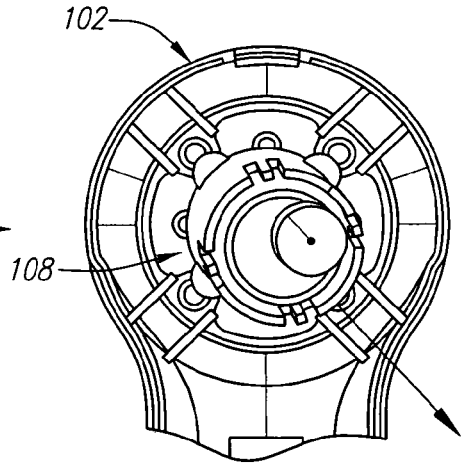

FIG. 8 is an exploded perspective view of another exemplary embodiment of handheld device 102 depicting the motion unit 108 within motion unit cavity portion 105 of front housing 603. As stated above, motion unit 108 is coupled with contact head 106, specifically motion head 604, through apertures 627 in elastic membrane 622. Preferably, the combination of motion unit 108 and contact head 106 is substantially suspended on membrane 22 and not otherwise coupled to the housing, in order to allow movement of the motion unit 108 and motion head 604 combination. Any electrical connections between motor 609 and activator 110 or power supply 114 are preferably flexible so as not to significantly restrict movement.

Motor 609 includes driveshaft 611 located along motor axis 804. Motor 609 rotates internal drive shaft 611 with offset weight 610 attached. The center of gravity of weight 610 is preferably offset from the rotational axis of driveshaft 611. As driveshaft 611 rotates in direction 802, the inertia generated by offset weight 610 cause the combination of motion unit 108 and motion head 604 to deflect accordingly.

FIGS. 9A-H depict perspective views of another exemplary embodiment of handheld device 102 at various stages during operation of motor 609. Here, back housing 602 is not shown in order to clearly depict the movement of motion unit 108. The torque of motor 609 coupled with the inertial effect of offset weight 610 causes motion unit 108 to deflect in various directions 902 in an orbital fashion as described above with respect to FIGS. 3-4. Contact surface 107 is similarly deflected since it is coupled with motion unit 108 via motion head 604. Preferably, motion head 604 is firmly affixed to motion unit 108 such that any deflection by motion unit 108 is directly transferred to contact surface 107. However, motion head 604 can be loosely affixed such that only a portion of the deflection of motion unit 108 is transferred to contact surface 107.

Figure 10:
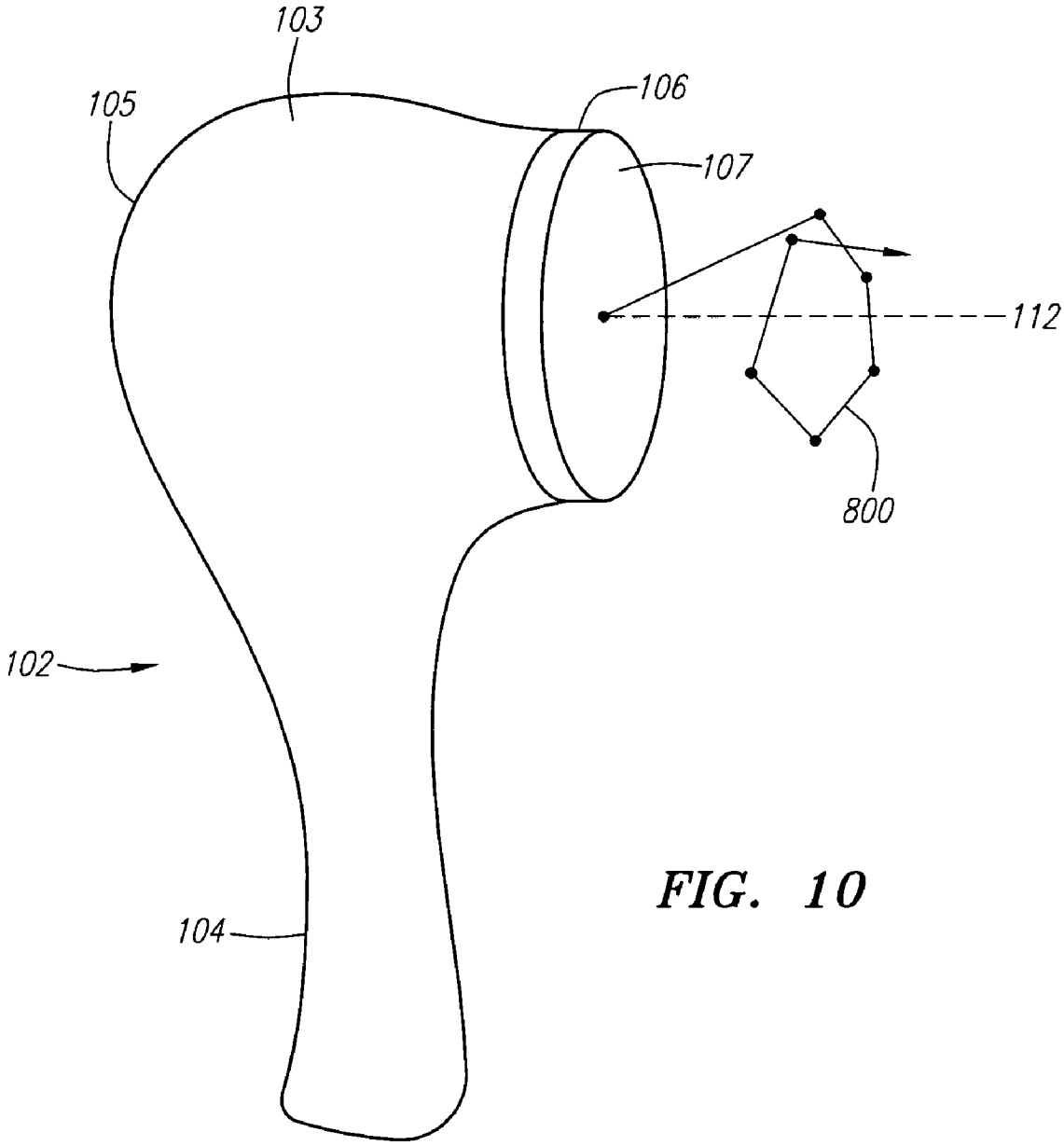
FIG. 10 depicts a perspective view of an exemplary embodiment of a handheld device configured for random orbital motion.

In this embodiment, motion unit 108 acts as a lever arm, which can be defined as the distance from offset weight 610 to elastic membrane 622. Because elastic membrane 622 is preferably coupled between motion unit 108 and motion head 604, the deflection of this lever arm forces membrane 622 to stretch and/or deform accordingly. When elastic membrane 622 stretches or deforms to the elastic limit in one direction, membrane 622 "snaps back," or reverses the direction of motion. The result can be a random orbital motion of contact surface 107 such as that depicted in FIG. 10. In FIG. 10, a perspective view of an exemplary embodiment of handheld device 102 is shown with a random direction of travel 800, which can occur in an embodiment of handheld device 102 having elastic membrane 622.

This embodiment of handheld device 102 also exhibits angular orbital motion similar to that described with respect to FIGS. 2A-C. The torque created by motor 609 causes the combination of motion unit 108 and contact head 106 to rotate orbitally about axis 112 until the elastic limit of membrane 622 is reached, at which point membrane 622 snaps back and causes motion unit 108 and contact head 106 to rotate orbitally in the opposite direction. Once the torque force combined with the elastic resistance to rotation in the opposite direction overcomes the inertia created by the "snap back," motion unit 108 and contact head 106 switch direction again and proceed to rotate orbitally in the original direction, that of the torque force. In this manner, contact surface 107 orbitally rotates back and forth about axis 1-12.

One of skill in the art will recognize that the elasticity of membrane 622 directly effects the three-dimensional orbital motion of contact surface 107. A relatively more elastic membrane 622 will allow a higher degree of deflection of contact surface 107 when acted upon by the cantilever force. A relatively greater elasticity will also allow a higher degree of angular orbital rotation of contact surface 107 about axis 112. Accordingly, the use of a relatively less elastic membrane 622 will decrease the range of motion over which contact surface 107 can travel. Preferably, the degree of elasticity of membrane 622 is chosen to suit the needs of the individual application. Here, elastic membrane is used to refer to any structure, planar or otherwise, which can allow the orbital motion described above with respect to any or all of FIGS. 2-4.

Skin care system 100 can be used with any skin care product. Skin care system 100 is especially suited for skin care products that benefit from the thorough exposure to the skin such as that generated by the orbital motion of contact surface 107. In one exemplary embodiment, skin care system 100 is provided with an exfoliator (or dermabrasion) product for removing dirt and dead skin and a moisturizer product for moisturizing the skin. A preferred embodiment of an exfoliator product usable with the skin care system 100 is described in U.S. Pat. No. 6,290,976, entitled "Facial Skin Dermabrasion Cleansing and Conditioning Composition," which is incorporated by reference herein.

In the foregoing specification, the invention has been described with reference to specific embodiments thereof. It will, however, be evident that various modifications and changes may be made thereto without departing from the broader spirit and scope of the invention. For example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A skin care device, comprising:

a device housing;

an elastic membrane coupled with the housing over an open portion of the housing;

a motion system coupled with the device housing, the motion system comprising a motor located within the housing; and a contact head coupled with the motor such that the elastic membrane is located therebetween a contact surface for contacting the skin of a subject and wherein the contact surface is located on the contact head; and wherein the contact surface is biased towards a first orientation and deflectable in a plurality of directions from the first orientation to a second orientation.

2. The device of claim 1, wherein the contact surface lies substantially along a first plane in the first orientation and lies substantially along a second plane in the second orientation, the second plane being oblique to the first plane.

3. The device of claim 2, wherein the contact surface is movable in an orbital manner back and forth about the first axis.

4. The device of claim 1, wherein the contact surface is movable in an orbital manner about a first axis normal to the contact surface, the first axis located substantially in the center of the contact surface.

5. The device of claim 1, wherein the contact surface is deflectable in a plurality of directions and orbitally movable such that the direction in which the surface is deflected shifts radially in a clockwise or counter-clockwise manner.

6. The device of claim 5, wherein the direction of deflection shifts radially in a continuous, stepped or random manner.

7. The device of claim 5, wherein the contact head is deflectable from a resting position and configured such that deflection of the contact head laterally shifts the position of the contact surface a distance from the resting position.

8. The device of claim 1, wherein the contact surface is retractable from a first position to a second position.

9. The device of claim 8, wherein the contact surface is adaptable to the contours of the body or skin.

10. The device of claim 1, wherein the contact head and motor are suspended by the membrane.

11. The device of claim 1, wherein the contact head comprises:

a motor head coupled with the motor; and a contact unit configured to couple with the motor head, wherein the contact surface is located on the contact unit.

12. The device of claim 11, wherein the contact unit is configured to removably couple with the motor head.

13. The device of claim 12, wherein the contact unit is configured to slidably couple with the motor head.

14. The device of claim 11, wherein the contact unit is interchangeable with a second contact unit.

15. The device of claim 1, further comprising a motor housing configured to house the motor and to couple the motor with the motor head via at least one aperture in the elastic membrane.

16. The device of claim 15, wherein the motor, motor housing and motor head are substantially suspended by the membrane.

17. The device of claim 16, wherein the motor has a rotatable driveshaft located along an axis of the motor, the axis being substantially normal to the contact head.

18. The device of claim 17, wherein the driveshaft has a first end adjacent to the contact head and a second opposite end, the second end coupled with a weight having a center of gravity offset from the motor axis.

19. The device of claim 17, wherein the motor and motor housing is configured as a lever arm upon the motor head.

20. The device of claim 1, wherein the contact head is movable in an orbital manner back and forth about a first axis normal to the contact surface, the first axis located substantially in the center of the contact surface.

21. The device of claim 20, wherein the contact surface is deflectable in a plurality of directions and orbitally movable such that the direction in which the surface is deflected shifts radially in a clockwise or counter-clockwise manner.

22. The device of claim 1, further comprising an applicator coupled with the motion system such that the contact surface is located on the applicator.

23. The device of claim 22, wherein the applicator is composed of a soft, porous material.

24. The device of claim 22, wherein the applicator is a sponge.

25. The device of claim 1, wherein the contact surface is configured to store a skin care substance and apply the substance to skin.

26. The device of claim 1, wherein the contact surface comprises an abrasive surface configured for skin exfoliation.

27. The device of claim 1, further comprising a motor housing coupled with the contact head and configured to house the motor.

28. The device of claim 27, wherein the motor has a rotatable driveshaft located along an axis of the motor, the axis being substantially normal to the contact head.

29. The device of claim 28, wherein the driveshaft has a first end and a second end adjacent to the contact head, the first end coupled with a weight having a center of gravity offset from the motor axis.

30. The device of claim 1, further comprising an activator electrically coupled with the motor and configured to activate the motor.

31. The device of claim 30, wherein the activator is configured to selectively operate the motor at one of a plurality of speeds upon activation of the motor.

* * * * *